United States Patent [19]

Focke et al.

[11] 4,196,842

[45] Apr. 8, 1980

[54] BLANKS AND STRIPS FOR THE PRODUCTION OF FLIP-TOP CIGARETTE BOXES

[75] Inventors: Heinz Focke; Kurt Liedtke, both of Verden, Fed. Rep. of Germany

[73] Assignee: Focke & Co., Verden, Fed. Rep. of Germany

[21] Appl. No.: 961,063

[22] Filed: Nov. 15, 1978

[30] Foreign Application Priority Data

Dec. 31, 1977 [DE] Fed. Rep. of Germany ..... 2759178

[51] Int. Cl.[2] ..... B65D 5/66; B65D 85/10

[52] U.S. Cl. ..... 229/44 CB; 229/16 A

[58] Field of Search ..... 229/44 CB, 16 A

[56] References Cited

U.S. PATENT DOCUMENTS 3,979,047 9/1976 Focke et al. ..... 229/44 CB 4,114,777 9/1978 Frohling et al. ..... 229/44 CB 4,121,756 10/1978 Focke et al. ..... 229/44 CB

FOREIGN PATENT DOCUMENTS 2642788 9/1976 Fed. Rep. of Germany ..... 229/44 CB

*Primary Examiner*—Davis T. Moorhead

*Attorney, Agent, or Firm*—Sughrue, Rothwell, Mion, Zinn and Macpeak

[57] ABSTRACT

The side edges of a blank from which a flip-top cigarette box may be folded have uneven length notched or toothed configurations formed by various flap portions of narrow and full width. Adjacent lines of blanks on a strip of packaging material are disposed in opposite directions with their toothed side edges matingly interleaved, to thereby minimize material waste. A collar 12 is also integrally defined on each blank adjacent the top edge of the front wall 15 of the box, and is inset to the inside in the folded box by a Z-shaped fold.

11 Claims, 2 Drawing Figures

BLANKS AND STRIPS FOR THE PRODUCTION OF FLIP-TOP CIGARETTE BOXES

BACKGROUND OF THE INVENTION

This invention relates to blanks and strips from which rectangular cigarette boxes of the hinged lid type may be folded, and to the resulting box itself. The blank has longitudinally successive areas for the front, floor and back walls of the box, followed by successive areas defining the back, ceiling and front walls of the lid. Various side and corner flaps are laterally connected to the wall areas, and are adapted to be overlapped during their folding. A collar portion is also connected to the front wall, and is displaced towards the interior of the box by means of a Z-shaped fold, such collar being surrounded in the closed position of the lid.

The folding boxes of the types here concerned are primarily intended to receive cigarettes, cigarillos and the like. The basic structure is of a rectangular nature with a folding lid hingedly connected to the back wall of the box. In the area of the front and side walls of the box opening an inwardly set back collar is provided with its front and side walls projecting upwardly and out of the box opening. This collar is surrounded by the folding lid when the box is closed.

SUMMARY OF THE INVENTION

The blank of the invention is intended for the production of cigarette boxes by means of longitudinal folding. The collar is uniquely formed integral with the blank and is connected to the upper edge of the front wall. The set back of the collar with respect to the front wall is accomplished by the above-mentioned z-fold or by material deformation pressing.

A basic object of the invention is to improve the blank configuration for folding boxes of this type while decreasing the material requirements and wastage. To achieve this object the blank is characterized by the inner side flaps connected to the back wall of the blank and the floor corner flaps having a narrower width than the outer side flaps, thus forming recesses along the sides of each blank. With such a blank configuration the overall surface area thereof is smaller than conventional blanks for such "flip-top" cigarette boxes, with the narrower width portions of the blank being followed by full width portions defining the outer side flaps of the box and lid.

Such a blank configuration enables a material saving arrangement wherein directionally reversed lines of blanks may be defined side-by-side in an interfitting manner on a strip of material from which the blanks are cut or formed, with the full width portions of the blanks in one line extending into the narrow width portions of the blanks in the adjacent line, and vice versa.

In the folded box the side walls of the collar lie directly against the inner surfaces of the outer side flaps of the box, and are secured thereto by glueing or the like. The narrow width inner side flaps of the main box portion are provided with notched cut-outs or recesses to accommodate the side flaps of the collar, whereby such inner and collar side flaps lie in the same plane against the inner surface of the outer side flaps, and overlapped or multiple layer areas are thus avoided.

DETAILED DESCRIPTION OF THE PREFERRED EMBODIMENT

Figure 1:
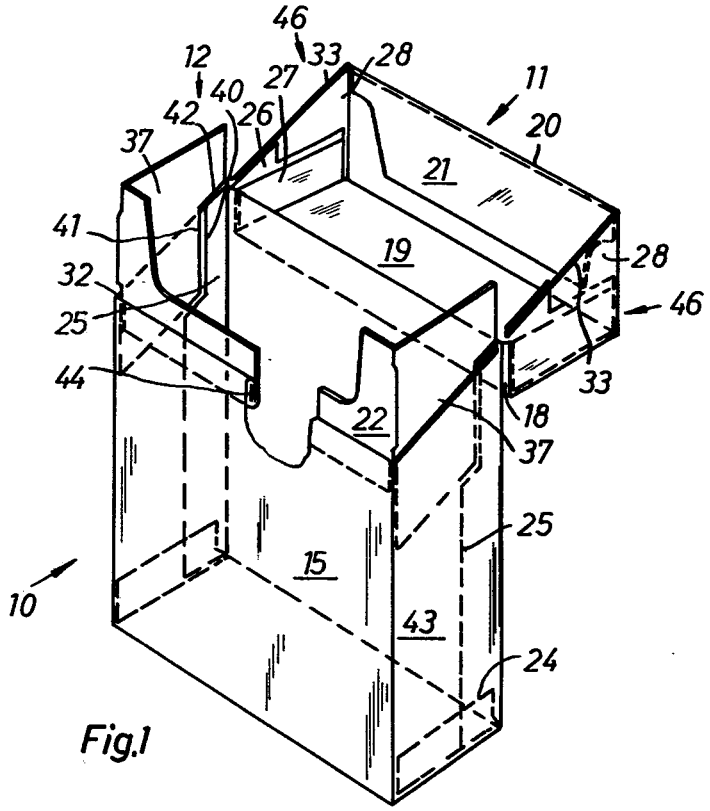
FIG. 1 shows a perspective view of a folded flip-top box according to the invention, with the lid in its open position.

Referring now to the drawings, a folding cigarette box according to the invention includes a main box portion 10 and a folding lid 11 hingedly connected thereto. A collar 12 projects out of the upper opening of the main box portion 10 and is surrounded at its front and sides by the folding lid 11 when the box is closed.

Figure 2:
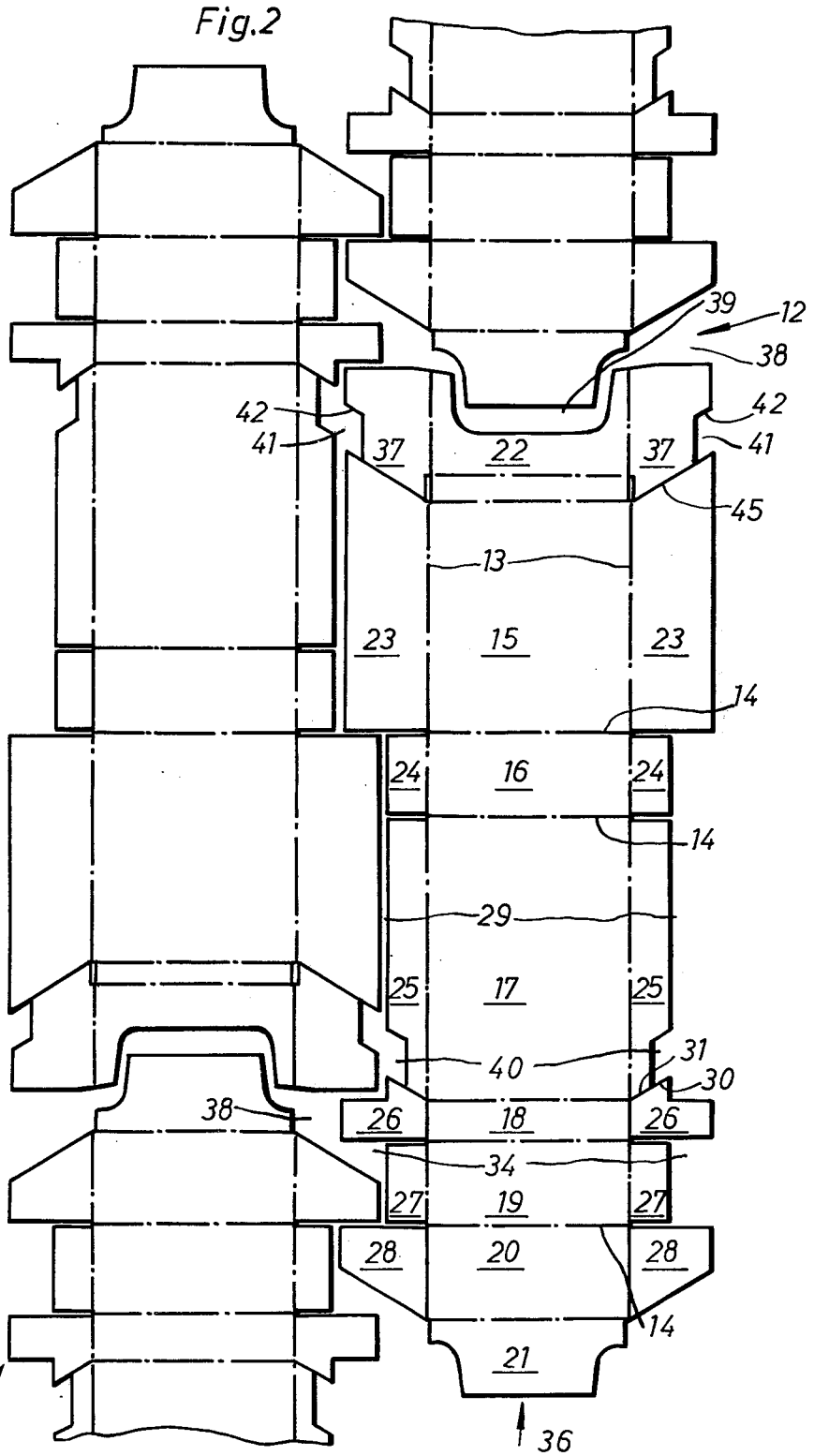
FIG. 2 shows a plan view of two lines of blanks according to the invention defined in an interlocking manner on a stip of packaging material.

The folded box shown in FIG. 1 is made from blanks as shown in FIG. 2. Each blank is divided into individual or discrete surface areas by longitudinal fold lines 13 and transverse fold lines 14. In the longitudinal direction of the blank, the adjacent surface areas include those of the front wall 15, the floor 16, the back wall 17, the lid back wall 18, the lid ceiling wall 19, and the lid front wall 20. An inner flap 21 is also joined to the lid front wall 20, and is folded thereagainst on the inside for reinforcement as seen in FIG. 1.

The collar 12 is also integrally defined on the same blank, and its front wall 22 is thus directly connected to the front wall 15 of the main box portion 10.

Each side of a blank includes, in succession, full width outer side flaps 23 joined to the front wall 15, reduced width corner flaps 24 and inner side flaps 25 connected to the floor 16 and back wall 17, respectively, full width lid side flaps 26 extending out from the lid back wall 18, narrow width lid corner flaps 27 joined to the lid ceiling wall 19, and full width lid side flaps 18 connected to the lid front wall 20.

In an exemplary embodiment the successive floor corner flaps 24 and inner side flaps 25 have an approximate width of 9 mm, and the full dimension outer side flaps 23 have an approximate width of 22.5 mm. This results in open, approximately rectangular side recesses 29 in each blank, which extend between the outer side flaps 23 and the inner lid side flaps 26. The latter are separated from the inner side flaps 25 by oblique cut lines, which produce correspondingly angled separation edges 30, 31. These edges are in turn parallel to the angled closing edges 32, 33 of the main box portion 10 and lid 11.

The narrow width lid corner flaps 27 define recesses 34 on the opposite sides of each blank, thus producing an uneven length toothed configuration along the sides of the blank. To effectively utilize these configurations and minimize material waste, the adjacent lines of blanks 35, 36 are reversed by 180° with respect to each other so that the side edges of the adjacent blanks may be interleaved as shown in FIG. 2. Thus, the full width outer side flaps 23 and adjacent collar side walls 37 are accommodated within the larger recesses 29 of the adjacent line of blanks, and the outer lid side flaps 28 of full width project into the recesses 34 in a similar manner. The remaining full width inner side flaps 26 are conveniently accommodated within recesses 38 defined between the mating edges of successive blanks in a line.

A waste minimizing and form-fitting disposition of successive blanks in each row is also provided, whereby each inner flap 21 is matingly received within a correspondingly shaped recess 39 of each collar front wall 22. Such a recess 39 is well known in the art, and affords the user easy and convenient access to the contents of each box.

The inner side flaps 25 and the collar side walls 37 are provided with side cut-outs 40, 41, respectively. In the side walls 37 this cut-out is formed adjacent to the side flap 23, and has an angled edge 42 parallel to the separating edges 30, 31.

In the folded box side walls 43 are formed from the partially overlapped inner side flaps 25 and outer side flaps 23, with the upright floor corner flaps 24 being folded between the flaps 23, 25 at the bottoms of the main box portion 10.

The collar 12 is set back or recessed to the inside of the box portion 10 by means of a Z-fold 44 at the top of the front wall 15. This results in a double layered partition between the collar front wall 22 and the front wall of the main box portion.

In the area of the side walls 43 the collar side walls 37 are severed from the outer side flaps 23 by oblique separating cuts 45. Thus, after folding, the collar side walls 37 lie against the insides of the outer side flaps 23 and are secured thereto by glueing or the like. The upper portions of the inner side flaps 25 and the lower portions of the collar side walls 37 mate together after folding by reason of the complementary cut-outs 40, 41, whereby these portions of the blank lie in a common plane. The edge 42 of the cut-out 41 lies along the closing edge 32 in the folded blank, and thus overlies the separation edge 31 of the side flap 25. The collar side walls 37 are thus inset by the thickness of one layer of the strip material.

Each lid side wall 46 is formed by a lid side flap 28 on the outside, a lid corner flap 27 on the inside, and an inner lid side flap 26 intermediate these two layers. Alternatively, the folding order of the flaps 26 and 27 may be reversed. Either way, the separation edge 30 of the lid side flap 26 will always lie along the closing edge 33 of the lid 11.

What is claimed is:

1. A blank from which a rectangular hinged-lid or flip-top box may be folded, said box including a main box portion and a hinged lid connected thereto, being particularly adapted to contain cigarettes or the like, and having longitudinally successive surface areas defining front, floor and back walls of the box portion, and successive areas following the back wall of the box portion defining back, ceiling and front wall of the lid portion, and laterally projecting side flaps, lid side flaps, floor corner flaps and lid corner flaps adapted to form side walls and lid side walls by their overlapped folding, and having a collar projecting out of the box portion having a front wall and side walls which are surrounded by the lid in its closed position, characterized by:

(a) said collar (12) being formed integral with said blank and connected in one piece therewith at least in the area of said front wall (15), (b) said collar (12) being inwardly displaced relative to said front wall (15) by deformation of the material, (c) said side flaps (25) which are laterally connected to the sides of said back wall (17) and said floor corner flaps (24) being of narrower width than said side flaps (23) which are connected to the front wall and lie on the outside of the finished package, thus forming lateral recesses (29), and (d) said lid corner flaps (27) being formed with narrower widths than the lid side flaps (28), thus forming additional recesses (34) along opposite sides of said blank.

2. Blank according to claim 1, wherein inner lid side flaps (26) are separated from adjacent side flaps (25) by cut edges (30, 31) which run parallel to angled closing edges (32, 33) of the box and lid, whereby the side recesses (29) extend into the area of the lid side flaps (26).

3. Blank according to claim 2 wherein the inner side flaps (25) and collar side walls (37) opposite the outer side flaps (23) have mating, parallelogram shaped cut-outs (40, 41).

4. A strip of paper or cardboard packaging material for the production of blanks according to claim 1, wherein wide areas of a line of blanks mate with side recesses in an adjacent line of blanks, characterized by: the outer, full-width side flaps (23) and collar side walls (37) connected thereto and having approximately the same width fitting into the side recess (29) of a blank in an adjacent line.

5. Strip according to claim 4, wherein the recess (29) is formed by a narrow width inner side flap (25), a floor corner flap (24) and a portion of an inner lid side flap (26).

6. Strip according to claim 5, wherein an outer lid side flap (28) is formed with a full width and fits into a side recess (34) of a blank in an adjacent line.

7. Strip according to claim 6, wherein the side recess (34) of the adjacent blank is formed by a narrow width lid corner flap (27).

8. Strip according to claim 7, wherein a full width inner lid side flap (26) fits into a gap (38) between successive blanks in the adjacent line.

9. A folding box made from a blank according to claim 1, wherein a lower portion of a collar side wall (37) is attached to the inner side of an outer side flap (23) in such a manner that an upper area of an inner side flap (25) projects into a cut-out (41) in the collar side wall and lies in the same plane therewith.

10. Folding box according to claim 9, wherein inner side flaps (25) and collar side walls (37) have respective cut-outs (40, 41) that mate together.

11. Folding box according to claim 10, wherein the inner side flap (25) and the cut-out (41) in the collar side wall (37) have angled closing edges contiguous with the upper edge of the main box side wall (43).

* * * * *